United States Patent [19]

Koike

[11] 4,453,439

[45] Jun. 12, 1984

[54] ELECTRONIC MUSICAL INSTRUMENT WITH GAME FUNCTION

[75] Inventor: Tatsuhiro Koike, Hamakita, Japan

[73] Assignee: Nippon Gakki Seizo Kabushiki Kaisha, Hamamatsu, Japan

[21] Appl. No.: 397,344

[22] Filed: Jul. 12, 1982

[30] Foreign Application Priority Data

Jul. 14, 1981 [JP] Japan ..... 56-109779
Aug. 31, 1981 [JP] Japan ..... 56-136276

[51] Int. Cl.[3] ..... G10H 1/053; G10H 5/00
[52] U.S. Cl. ..... 84/1.01; 84/1.24
[58] Field of Search ..... 84/1.01, 1.17, 1.24, 84/1.25

[56] References Cited

U.S. PATENT DOCUMENTS 4,198,892 4/1980 Gross ..... 84/1.25

*Primary Examiner*—S. J. Witkowski
*Attorney, Agent, or Firm*—Cushman, Darby & Cushman

[57] ABSTRACT

An electronic musical instrument with a game function is capable of being used either to play music or to play a ball-hitting game. The electronic musical instrument comprises a keyboard having a plurality of keys for generating a first key data which is supplied to a musical tone generating circuit for producing a musical tone corresponding to the first key data, thus enabling to play music in a conventional manner. In addition, the electronic musical instrument comprises for use in a game mode a data generating circuit for generating a second key data representing a pitch of a key and varying its pitch in either one of directions to sequentially take a higher and a lower pitch respectively. The second key data is supplied to the musical tone generating circuit for producing a musical tone, thus simulating the movement of a ball. The second key data is compared with the first key data to generate a coincidence signal when both key data substantially coincide with each other. The coincidence signal causes the data generating circuit to make the second data vary a direction of the pitch variation, thereby enabling to simulate a ball-hitting. Other associated circuitries for controlling a ball speed, scoring and displaying a point, and the like are also provided.

7 Claims, 3 Drawing Figures

ELECTRONIC MUSICAL INSTRUMENT WITH GAME FUNCTION

BACKGROUND OF THE INVENTION

1. Field of the Invention

This invention relates to an electronic musical instrument with a game function.

2. Description of the Prior Art

Generally, it is desirable to give children a musical or acoustic education while they are enjoying a game. Conventional electronic musical instruments have not had the nature of a game at all so that players, particularly children, become easily tired of them. Thus, the conventional electronic musical instruments have been found to be not always suited to children's acoustic training.

SUMMARY OF THE INVENTION

It is therefore an object of this invention to provide an electronic musical instrument with a game function by which a player can receive an acoustic training while he is enjoying a "ball-hitting" game.

To accomplish the above and other objects, there is provided an electronic musical instrument which, in addition to its essential function to play music in a conventional manner, is capable of producing a rapid series of consecutive musical tones in a glissando manner to represent a movement of a ball; controlling the speed of change of the musical tones representative of the movement of the ball; representing a movement of a racket to simulate a ball-hitting action by the depression of each key on the keyboard; and providing other game functions accompanied by, for example, a tennis game.

More in detail, the electronic musical instrument according to the invention has a function to play music in a conventional manner. For this purpose, there is provided a keyboard and a musical tone generating circuit which are well known in the art. The keyboard has a plurality of keys and is adapted to generate a key data corresponding to a key or keys depressed. The musical tone generating circuit produces a musical tone corresponding to the key data. Thus, in a music play mode, the electronic musical instrument serves as an electronic organ or other musical instruments. In addition to the above function, the electronic musical instrument according to the invention can be used as a ball-hitting game instrument such as a tennis or the like. The application of the electronic musical instrument to a ball-hitting can be attained by the provision of a pitch data generating circuit. The pitch data generating circuit generates a pitch data varying its pitch in a glissando manner from a lower pitch to a higher pitch, or vice versa. In a game play mode, the pitch data is supplied to the musical tone generating circuit to produce a corresponding musical tone which simulates a movement of a ball. Each of the musical tones produced by the pitch data can be identified as corresponding to any one of the keys on the keyboard. Thus, the player can identify the musical tone or hit the ball by depressing the appropriate key which he considers to be the one corresponding to the musical tone at the time. The musical tone generating circuit is provided with other associated circuitries to control it for rendering a service, varying a speed of the ball movement, hitting the ball, determining whether the ball was hit or mishit, scoring and displaying a point and the like.

According to one aspect of the invention, an electronic muscial instrument capable of carrying out a musical game, comprises: keyboard means having a plurality of keys for generating a first key data corresponding to a pitch of a key depressed among said plurality of keys; data generating means for generating a second key data representing a pitch of a key and varying its pitch in either one of directions to sequentially take a higher and a lower pitch respectively; means for comparing said first and second key data for generating a coincidence signal when both said first and second key data substantially coincide with each other within a predetermined pitch difference therebetween; means responsive to said coincidence signal for causing said data generating means to determine the direction of further pitch variation of said second key data; and musical tone generating means for producing a musical tone selectively corresponding to said first and second key data.

The foregoing and other objects, the features and the advantages of the present invention will be pointed out in, or apparent from, the following description of the preferred embodiment considered together with the accompanying drawings.

DETAILED DESCRIPTION OF THE INVENTION

Figure 1:
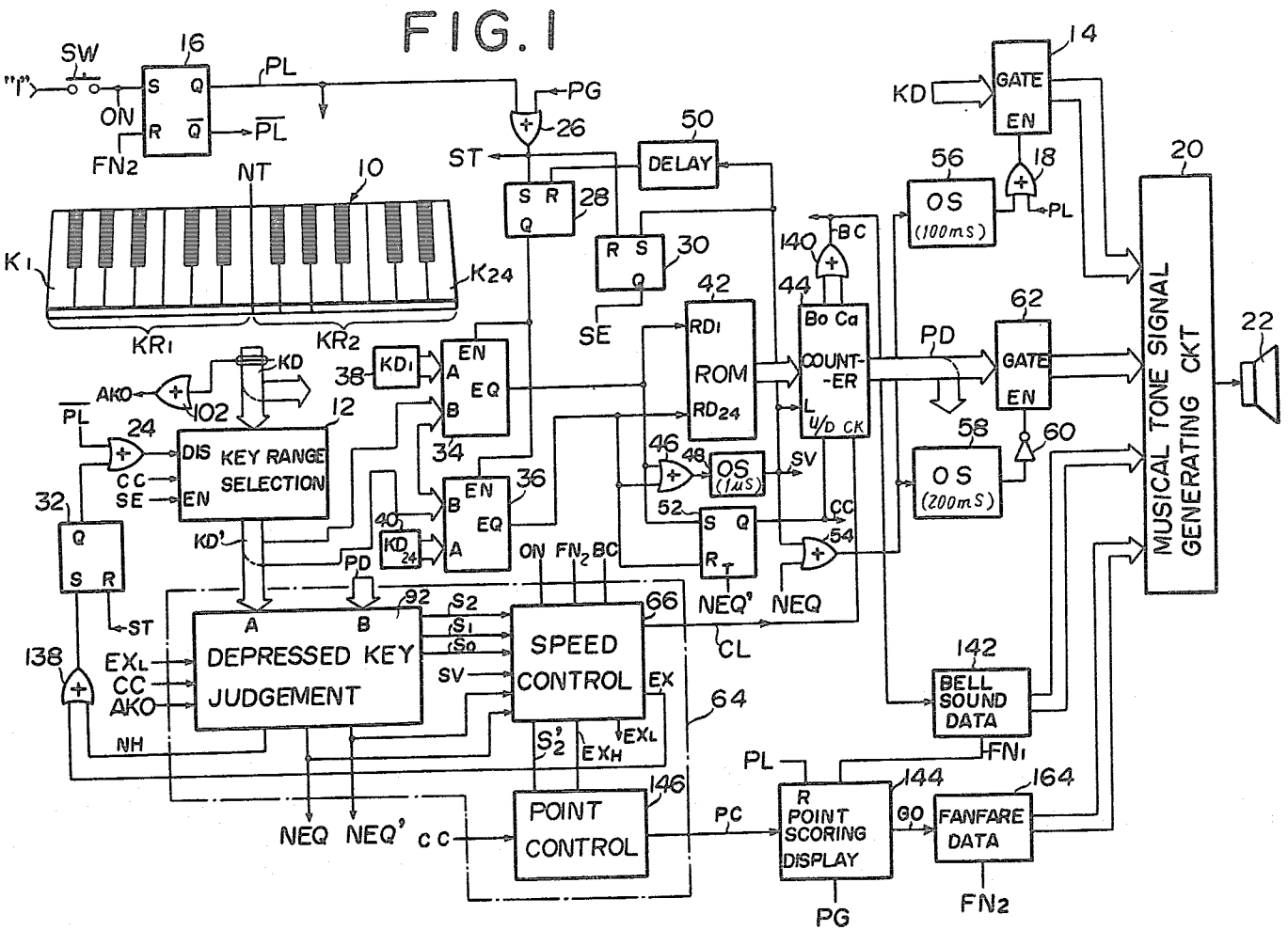
FIG. 1 is a schematic circuit diagram of a preferred embodiment of a musical instrument with a game function according to the present invention.

FIG. 1 shows an embodiment of an electronic musical instrument according to the invention in which consecutive musical tones produced in a glissando manner represent the movement of a ball, while operated or depressed keys on a keyboard are indicative of the movement of a racket, thereby simulating a ball-hitting game resembling tennis.

A keyboard 10 comprises illustratively in this embodiment twenty four (24) keys and supplies a key data KD representing a pitch of a depressed key to a key range selection circuit 12 as well as to a gate circuit 14.

(I) Music Play Mode

In a music play mode, a game play switch SW is turned off to reset an R-S flip-flop 16 to thereby generate at the output $\overline{Q}$ thereof a non-play or music play mode signal $\overline{PL}$ having a value of $\overline{Q}$="1". The non-play signal $\overline{PL}$ is supplied as an enable signal EN to a gate circuit 14 through an OR gate 18, so that the gate circuit 14 supplies the depressed key data KD from the keyboard 10 to a musical tone signal generating circuit 20. The musical tone signal generating circuit 20 generates a musical tone signal corresponding to the depressed key data KD indicative of a depressed key, which musical tone signal is supplied to a loudspeaker 22. The speaker 22 generates a musical tone corresponding to the depressed key, thus making it possible to play music in a conventional manner. In the music play mode, a non-play mode signal $\overline{PL}$ is supplied through an OR gate 24 to a key range selection circuit 12, so that a game play described later is prevented from being performed.

(II) Game Play Mode

In a game play mode, the game play switch SW is turned on to set the R-S flip-flop 16 by applying an on-signal ON="1" to the set terminal thereof. Thus, a play mode signal PL is generated at the output Q of the flip-flop 16 having a value of Q="1", and the non-play mode signal $\overline{PL}$ the gate circuit 14 non-conductive by way of the OR gate 18 so that playing music with the keyboard 10 is prevented. However, with the keyboard 10 operated, a game resembling tennis can be enjoyed which is described in detail hereinunder.

Through the OR gate 24, the non-play mode signal $\overline{PL}$="0" releases the key range selection circuit 12 from its disable state. The play mode signal PL appears at the output of an OR gate 26 as a start signal ST, then it sets an R-S flip-flop 28 and concurrently resets R-S flip-flops 30 and 32. The output Q="1" of the flip-flop 28 is supplied as enable signals EN to comparison circuits 34 and 36 so that the comparison circuits 34 and 36 can perform an operation comparing inputs A and B both supplied to the respective circuits 34 and 36. Since the reset signals delivered to the flip-flops 30 and 32 do not change the disable-released state of the key range selection circuit 12, the depressed key data KD from any key in the entire key range of the keyboard 10 can be outputted from the key range selection circuit 12 as a depressed key data KD' which is supplied as the inputs B to the comparison circuits 34 and 36. A key data $KD_1$ indicative of the lowest key $K_1$ of the keyboard 10 is supplied from a data source 38 to the comparison circuit 34 as the input A, and a key data $KD_{24}$ indicative of the highest key $K_{24}$ of the keyboard 10 is supplied from a data source 40 to the comparison circuit 36 as the input A.

In the game play mode, the keyboard 10 is divided into two key ranges $KR_1$ and $KR_2$ at a central position NT corresponding to a net. A right-hand court corresponds to the second key range $KR_2$ which includes twelve keys at the higher musical tones, and a left-hand court corresponds to the first key range $KR_1$ which includes twelve keys at the lower musical tones.

(1) Serving a ball by depressing a key $K_1$ of the first key range $KR_1$

Upon depression of the key $K_1$, the comparison circuit 34 generates a coincidence signal EQ. Since the coincidence signal EQ is supplied to a ROM (Read Only Memory) 42 as a read control signal $RD_1$, a data corresponding to the $K_1$ is read out from the ROM 42 and supplied to a programmable up/down counter 44. The coincidence signal EQ from the comparison circuit 34 is also supplied through an OR gate 46 to a one-shot circuit 48 to be converted to a service signal SV having a pulse width of 1 μs. The service signal SV is supplied to the counter 44 as a load signal L so that the data corresponding to the pitch of the key $K_1$ is loaded from the ROM 42 to the counter 44. The service signal SV is subjected to a slight time delay by a delay circuit 50 and resets the flip-flop 28 to prevent the comparison operation of the comparison circuits 34 and 36.

The service signal SV sets the flip-flop 30, the output Q="1" of which serves as a service end signal SE. The service end signal SE is supplied to the key range selection circuit 12 as an enable signal EN for the selection operation of the key region thereof. The key range selection circuit 12 further receives a selection control signal CC comprising the output of an R-S-T flip-flop 52 for the control of the key region selection operation. Since the flip-flop 52 is set by the coincidence signal EQ from the comparison circuit 34, the selection control signal CC is turned to be "1" so that the key range selection circuit 12 selects the second key range $KR_2$ and is made ready to deliver the depressed key data KD' only from the second key range $KR_2$.

The selection control signal CC from the flip-flop 52 is supplied to the counter 44 as a counting mode setting signal U/D. In the case of CC="1" state as above, the counter 44 is set to an up-count mode.

(2) Serving a ball by depressing a key $K_{24}$ of the second key range $KR_2$

Upon depression of the key $K_{24}$, the comparison circuit 36 generates a coincidence signal EQ. The coincidence signal EQ is supplied to the ROM 42 as a read control signal $RD_{24}$ to read therefrom a data corresponding to the pitch of the key $K_{24}$, and is supplied to the one-shot circuit 48 through the OR gate 46 to be converted into a service signal SV. The coincidence signal EQ from the comparison circuit 36 resets the flip-flop 52 to set the selection control signal CC at "0". As a result, the data read out of the ROM 42 is loaded to the counter 44 in response to the service signal SV, the comparison circuits 34 and 36 stop the comparison operation in response to the reset of the flip-flop 28 upon reception of the service signal SV through the delay circuit 50, the key region selection circuit 12 selectively delivers a depressed data KD' only from the first key range $KR_1$ in response to the selection control signal CC="0", and the counter 44 is set to a down-count mode in response to the selection control signal CC="0".

The service signal SV, generated by the depression of either the key $K_1$ or the key $K_{24}$, is supplied via an OR gate 54 to one-shot circuits 56 and 58. The one-shot circuit 56 generates an output signal of a 100 ms pulse width in response to an output signal of the OR gate 54, and the output signal of the one-shot circuit 56 renders the gate circuit 14 conductive through the OR gate 18 during a time interval of 100 ms. Consequently, a musical tone corresponding to the depressed key or service key is generated during 100 ms. The one-shot circuit 58 generates an output signal of a 200 ms pulse width in response to the output signal of the OR gate 54. The output of the one-shot circuit 58 is supplied to the gate circuit 62 through an inverter 62 to prevent a pitch data PD from the counter 44 from being supplied to the musical tone signal generating circuit 20 during the 200 ms time interval from the depression of the service key. Thus, no musical tone corresponding to the pitch data PD is generated during that time.

(3) Speed Control Circuit

The service signal SV is supplied to a speed control circuit of a depressed key judgement and speed control section 64. In the speed control circuit 66 as particularly shown in FIG. 2, with the service signal SV supplied to a latch circuit 68 as a preset signal PS, an initial data for setting a pitch variation rate at the start of delivering a service is preset in the latch circuit 68 from a service ROM 70. The service signal SV is also supplied to a latch circuit 76 via an OR gate 72 and a delay circuit 74 as a preset signal PS to thereby preset in the latch circuit 76 the initial data from the latch circuit 68. The initial data is first supplied to a clock generator 78 as a clock frequency control signal. An on-signal ON, generated at the time the game play switch SW is turned on, is supplied through an OR gate 80 to an R-S flip-flop 82 to set it, so that the output Q="1" of the R-S flip-flop 82 resets the clock generator 78 through an OR gate 84. Thereafter, the delay circuit 74 generates an output signal which resets the flip-flop 82. At the same time a one-shot circuit 86 generates an output signal having a 200 ms pulse width which again resets the clock generator 78 through the OR gate 84. Therefore, a clock signal CL is prevented from being developed from the clock generator 78 for the time of 200 ms after delivering a service. This inhibited time interval of 200 ms corresponds to that of the prevention of the pitch data by the gate circuit 62. The reason for this is that there is no need for the clock signal CL to be supplied to the counter 44, because a musical tone corresponding to the pitch data PD is not generated during the period of 200 ms after delivering a service.

After the lapse of about 200 ms from the time a service is delivered, the gate circuit 62 is rendered enabled, and also the clock generator 78 provides the clock signal CL to the counter 44. The frequency of the clock signal CL is decided in accordance with the initial data preset in the latch circuit 76. The clock generator 76 generates a clock signal CL whose first pulse is supplied as a load signal to the latch circuit 76. As a result, the initial data from the latch circuit 76 and a 3 ms data from a ROM 90 are added together at an addition circuit 76, thereby increasing by 3 ms the time interval of the first and succeeding pulses of the clock signal CL. Similarly to the above, every time the pulse is generated from the clock generator 78, the time intervals between the following pulses are increased so that the frequency of the clock signal CL is gradually decreased.

Figure 3:
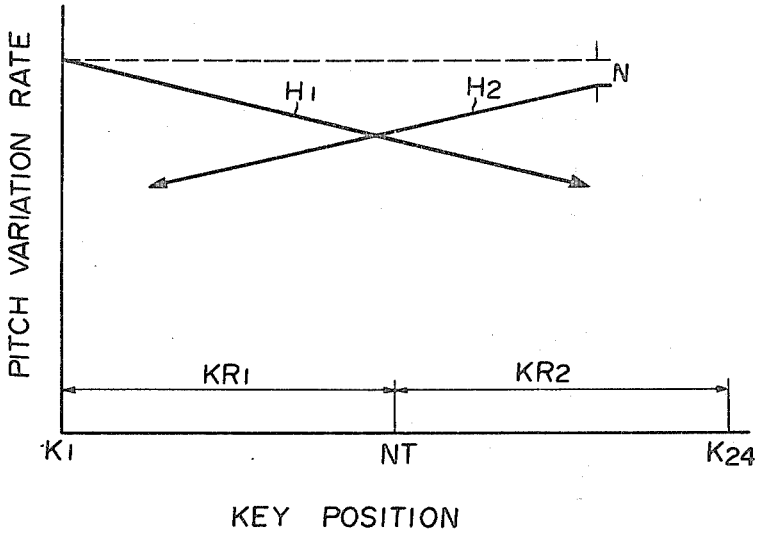
FIG. 3 shows illustratively an example of a relation between a key position and pitch variation rate in which a straight line $H_1$ represents a movement of a ball after a service delivered and a straight line $H_2$ represents a movement of the ball after it was returned.

Thus gradually decreasing clock signal CL is supplied to the counter 44 as a clock signal CK, and is counted thereby. Consequently, the pitch data PD from the counter 44 changes its pitch in the order of from the key $K_1$ to the key $K_{24}$ when in an up-count mode, or in the order of from the key $K_{24}$ to the key $K_1$ when in a down-count mode. In both count modes, the variation rate of the pitch data PD is gradually lowered in accordance with the frequency decrement of the clock signal CL. A straight line designated as $H_1$ in FIG. 3 shows such a lowering of the pitch variation rate in the up-count mode.

The pitch data PD is supplied through the gate circuit 62 to the musical tone signal generating circuit 20 in which a musical tone signal is generated and supplied to the loudspeaker 22. Accordingly, a series of consecutive musical tones corresponding to the pitch data PD are generated at the speaker 22 in a glissando manner, thereby simulating the movement of a ball.

(4) Depressed Key Judging Circuit or Returning the Service

The pitch data PD is supplied as an input B to a depressed key judging circuit 92 whose input A is the depressed key data KD' from the key region selection circuit 12. The depressed key judging circuit 92 as shown particularly in FIG. 2 comprises first and second comparison circuits 94 and 96. The depressed key data KD' and pitch data PD are supplied respectively as input A and input B to both first and second comparison circuits 94 and 96. The first comparison circuit 94 starts to compare the input A with the input B upon reception of an enable signal EN from an AND gate 98, and delivers an output signal which represents when any one of the condition A=(B−2), A=(B−1) or A=B is met, or delivers an output signal NO when none of the above conditions is met. The second comparison circuit 96 starts to compare the input A with the input B upon reception of an enable signal EN from an AND gate 100, and delivers an output signal which represents when any one of the conditions A=(B+2), A=(B+1), or A=B is met, or delivers an output signal NO when none of these conditions is met.

The AND gate 98 receives an any-key-on signal AKO from an OR gate 102 to which the depressed key data KD from the keyboard 10 is supplied, and also receives or selection control signal CC from the flip-flop 52. The AND gate 100 receives the any-key-on signal AKO, and a signal from an inverter 104, the latter signal being an inverted signal of the selection control signal CC. Thus, when the signal AKO is turned to be "1" upon the depression of any key of the keyboard 10, the first comparison circuit 94 is rendered to be operative upon reception of the selection control signal CC of a value "1", and the second comparison circuit 96 upon reception of the selection control signal CC of a value "0".

When a musical tone is moving up the scale from the key $K_1$ to the key $K_{24}$ after the key $K_1$ is depressed for rendering a service, it is assumed that any one of the keys within the second key range $KR_2$ is depressed for returning the service. The first comparison circuit 94 compares the depressed key data KD' with the pitch data PD in such a manner that an output signal corresponding to A=(B−2) is generated when the pitch of the data PD is lower by two keys than that corresponding to the key position depressed in the second key range, an output signal corresponding to A=(B−1) is generated when the pitch of the data PD is lower by one key than that corresponding to the key position depressed, an output signal corresponding to A=B is generated when the pitch of the data PD is equal to that corresponding to the key position depressed, and an output signal NO representing a mishit is generated when the pitch of the data PD is out of the pitch range corresponding to the difference or coincidence of key positions described above.

Contrary to the above, when a musical tone is moving down the scale from the key $K_{24}$ to the key $K_1$ after the key $K_{24}$ is depressed for rendering a service, it is assumed that any one of the keys within the first key range $KR_1$ is depressed for returning the service. The second comparison circuit 96 compares the depressed key data KD' with the pitch data PD in such a manner that an output signal corresponding to A=(B+2) is generated when the pitch of the data PD is higher by two keys than that corresponding to the key position depressed in the first key range, an output signal corresponding to A=(B+1) is generated when the pitch of the data PD is higher by one key than that corresponding to the key position depressed, an output signal corresponding to A=B is generated when the pitch of the data PD is equal to that corresponding to the key position depressed, and an output signal NO representing a mishit is generated when the pitch of the data PD is out of the pitch range corresponding to the difference or coincidence of key positions described above.

The output signals from the first and second comparison circuits 94 and 96 corresponding respectively to the conditions A=(B+2), A=(B+1), and A=B are supplied to respective OR gates 106, 108, and 110. The OR gate 106 delivers a hit signal $S_2$ indicative of the two-key difference, the OR gate 108 delivers a hit signal $S_1$ indicative of the one-key difference, and the OR gate 110 delivers a hit signal $S_0$ indicative of coincidence.

The hit signals $S_0$ through $S_2$ are supplied through an OR gate 112 to a one-shot circuit 114 which in response to the hit signals $S_0$ through $S_2$ generates a hitting signal NEQ having a 1 μs pulse width. The hit signal NEQ is delayed by 1 μs by a delay circuit 116, and is delivered from an AND gate 120 as a delayed hit signal NEQ' provided that the AND gate receives the output of "1" from an inverter 118. The output signals NO from the first and second comparison circuits 94 and 96 are supplied through an OR gate 122 to a one-shot circuit 124 which in response to the output signal NO generates a mishit signal NH.

(4–1) After generation of hit signals $S_0$ through $S_2$

If any one of the hit signals $S_0$ through $S_2$ is generated, when the difference between the pitches corresponding to the pitch data PD and that of the key position depressed comes within the pitch range corresponding to two-key difference, then a reset preferential type R-S flip-flop 128, 130 or 132, which has been reset by the service signal SV from the OR gate 126, is set by the respective hit signals $S_2$, $S_1$ or $S_0$. Immediately following the set operation, the flip-flop (either one of the flip-flops 128, 130 and 132) under its set state is again reset. The outputs Q of the flip-flops 128, 130 and 132 are respectively supplied to a correction value ROM 134, so that data representing correction values N, 0, and −N are read out from the ROM 134 in response to the respective hit signals $S_2$, $S_1$ and $S_0$ to supply them to an addition circuit 136 as one of the inputs thereof.

As the other of the inputs of the addition circuit 136, the initial data from the latch circuit 68 is supplied so that the addition circuit 136 adds the data read out from the ROM 134 and the initial data to thereby supply the added data to the latch circuit 68. At this time instant, since a signal delayed at a delay circuit 138 by 1 μs from the delayed hit signal NEQ' is supplied to the latch circuit 68 as a load signal L, the added data from the addition circuit 136 is loaded and latched into the latch circuit 68.

The signal delayed at the delay circuit 138 is also supplied through the OR gate 72 and delay circuit 74 to the latch circuit 68 as a preset signal PS. Upon reception of the preset signal, the added data from the latch circuit 68 is preset at the latch circuit 76. As a result, the clock generator 78 generates three different clock signals CL: that is, when a depressed key position differs by two key positions (i.e., generation of the signal $S_2$), a clock signal CL having a higher initial speed or frequency by N than the initial speed or data at the time of a service is generated, a clock signal CL having an equal initial speed or frequency to the initial speed or data at the time of a service is generated, when a key position differs by one key position (i.e., generation of the signal $S_1$), or a clock signal CL having a lower initial speed or frequency by N than the initial speed or data at the time of a service is generated, when a depressed key position coincides with that corresponding to the pitch data generated at the time (i.e., generation of the signal $S_0$). In other words, since the musical game according to this embodiment simulates tennis, the speed of a returned ball becomes fast as the timing of a return hit is fast within an allowable hit timing while it becomes slow when the hit timing is late. As previously described, the time intervals between the pulses from the clock generator 78 increase by 3 ms, so that the frequency of the clock signal CL is gradually decreased.

The counter 44 counts the clock signal CL in a different manner from the previous count mode, because the selection control signal CC of the flip-flop 52 is inverted by the delayed hit signal NEQ'. Thus, the pitch data PD from the counter 44 changes its pitch in a different direction from the previous one thereby to change the direction of the musical tone in a different direction. In addition to the above, the inverted selection control signal CC causes the key ranges to be selected in the key range selection circuit 12 to interchange with each other and also the comparison circuits to be selected in the depressed key determining circuit 92 to interchange with each other.

As shown in FIG. 3, after delivering a service which is simulated by the depression of the key $K_1$ of the first key region $KR_1$, the movement of a ball (corresponding to the movement of the musical tone in a glissando manner) is stopped and returned by the depression of any one of the keys of the second key range $KR_2$. At this moment, the selection control signal CC is rendered to be "0" from its previous level "1". In response to the "0" level of the signal CC, the counter 44 counts the clock signal CL in a down-count mode, the key range selection circuit 12 selects and delivers the depressed key data from the first key region $KR_1$, and the comparison circuit 96 in the depressed key judging circuit 92 is activated to compare the data. A straight line $H_2$ shown in FIG. 3 represents a pitch variation rate starting from at a slower initial speed by N than that at the time of a service, and thereafter gradually decreasing. This is the case that a ball was returned at such a timing as KD'=PD.

It is seen that since the hit signal NEQ is supplied through the OR gate 54 to the one-shot circuits 56 and 58, similarly as in the case of rendering a service, a musical tone corresponding to the depressed key is produced from the loudspeaker 22 during a time interval of 100 ms, and a muscial tone corresponding to the pitch data PD is prevented from being generated during a time interval of 200 ms.

After the direction of the movement of the ball is reversed, the ball is hit by a key of the first key range $KR_1$ toward the second key region $KR_2$, and thereafter similar performance is repeated to effect a tennis rally.

(4–2) After generation of the mishit signal NH

Figure 2:
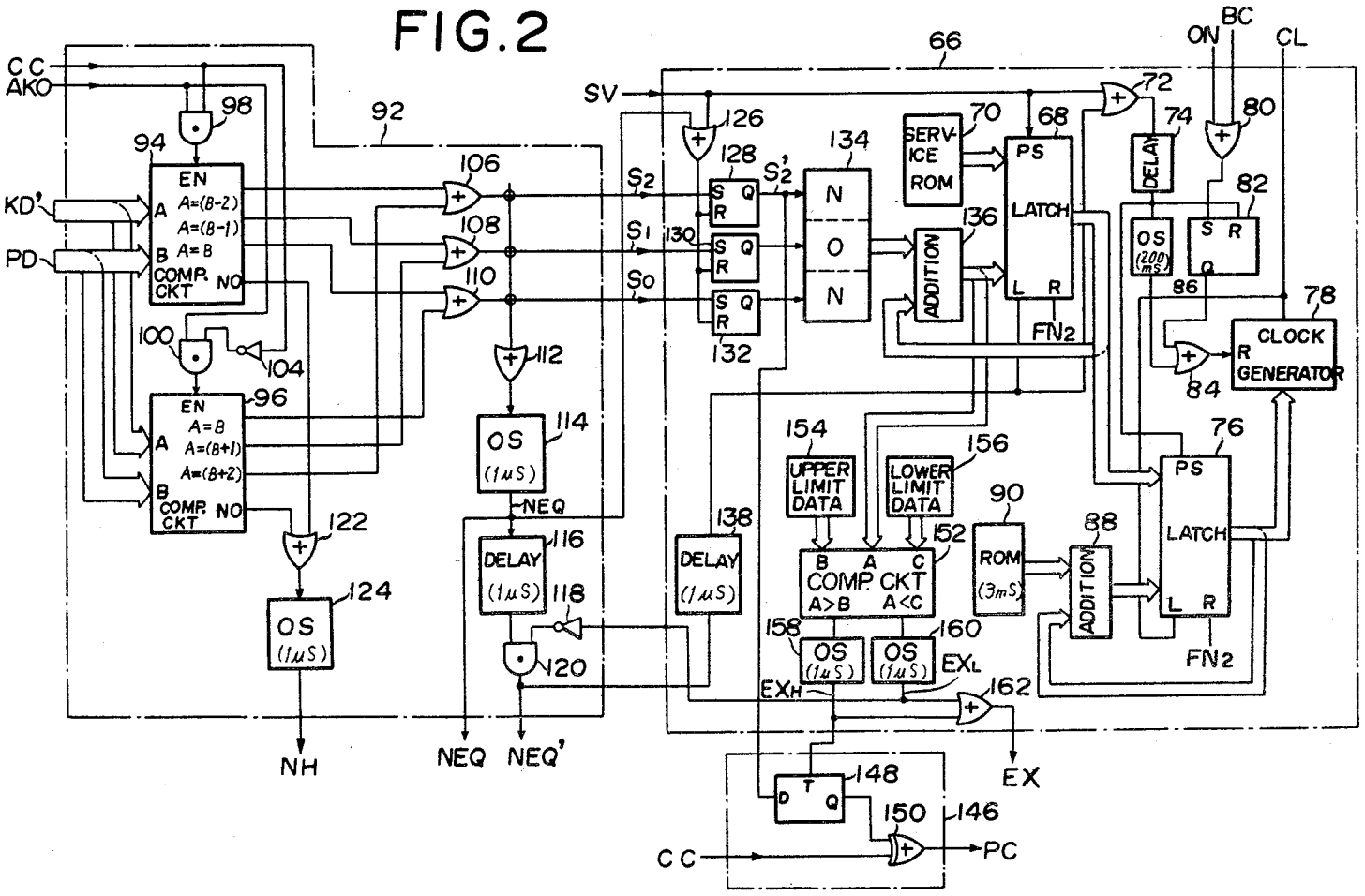
FIG. 2 is a schematic circuit diagram illustrating a depressed key judgement and speed control section shown in FIG. 1.

During a continuing tennis rally, if any one of the keys in either key range does not hit the ball successfully, a mishit signal NH is generated from the depressed key judging circuit 92. As shown in FIG. 1, the mishit signal NH resets the flip-flop 32 by way of the OR gate 138 so that the output Q="1" of the flip-flop 32 causes, through the OR gate 24, the key range selection circuit 12 to be in a disable state. In this case, the pitch data PD from the counter 44 continue to change its pitch up to that corresponding to the key $K_1$ or $K_{24}$, thereby simulating the ball running to the base line of the tennis court. Then, the counter 44 generates either a carry signal Ca in the up-count mode or a borrow signal $B_0$ in the down-count mode and feeds it to an OR gate 140. The OR gate 140 generates an output signal BC in response to the carry or borrow signal Ca or $B_0$, which output signal BC as shown in FIG. 2 sets the flip-flop 82 by way of the OR gate 80. The output Q="1" of the flip-flop 82 sets the clock generator 78 by way of the OR gate 84 so as to prevent the generation of the clock signal CL.

The output signal BC from the OR gate 140 enables the bell sound data generating circuit 142 shown in FIG. 1 to supply a bell sound data to the musical tone signal generating circuit 20 thereby producing from the loudspeaker 22 a bell sound which represents a point is scored in a tennis game. The bell sound data generating circuit 142 generates at the end of the bell sound a bell sound finish signal FN. The bell sound finish signal $FN_1$ is supplied to a point scoring and display circuit 144 which has been reset by the application of the play mode signal PL at the start of a game. The point scoring and display circuit 144 receives a point control signal PC from a point control circuit 146 which as shown in FIG. 2 delivers the selection control signal CC through an EXCLUSIVE OR gate 150 as a point control signal PC when the output Q of a D-type flip-flop 148 is "0". The circuit 144 scores a point for the $KR_1$ side if PC="1" and for the $KR_2$ side if PC="0". As a result, the point scoring and display circuit 144 scores a point and displays it on a display device (not shown) comprising liquid crystal or the like in such a manner that when the selection control signal CC is "1", a point is scored for a player at the first key range $KR_1$, and when the selection control signal CC is "0", a point is scored for another player at the second key range $KR_2$. The point scoring and display circuit 144 generates after completion of the display of the score a point get signal PG which is applied to the OR gate 26 to generate a start signal ST. The start signal ST sets the flip-flop 28 and resets the flip-flops 30 and 32 thereby enabling the next rally to start similarly as in the case of the previous start signal.

(4–3) Point scoring by mishitting other than as described above.

The above description (4–2) relates to scoring a point when the player cannot hit a ball. However, there are other occasions by which a point is gained or lost. That is, when the initial speed (pitch variation rate) of the movement of a ball at the time a key is depressed, is too high or low. The operation of such cases will be described hereinunder.

Referring to FIG. 2, the added data from the addition circuit 136, which determines an initial speed at the time when a key is depressed (or a ball is hit), is supplied to a comparison circuit 152 as an input A. Data from upper and lower limit data sources 154 and 156 respectively corresponding to upper and lower speeds are supplied to the comparison circuit 152 respectively as inputs B and C. The comparison circuit 152 compares the inputs A and B as well as the inputs A and C, in order to output an output signal to a one-shot circuit 158 when the initial speed is higher than the upper limit speed i.e., $A>B$, and to output an output signal to a one-shot circuit 160 when the initial speed is lower than the lower limit speed i.e., $A<C$. The one-shot circuit 158 generates an excessive speed signal $EX_H$ of a 1 μs pulse width in response to the output signal corresponding to a condition $A>B$, while the one-shot circuit 160 generates a deficient speed signal $EX_L$ of a 1 μs pulse width in response to the output signal corresponding to a condition $A<C$. The excessive and deficient speed signals $EX_H$ and $EX_L$ are supplied to an OR gate 162 to generate therefrom an output signal EX upon reception of either one of the signals $EX_H$ and $EX_L$. The output signal EX sets the flip-flop 32 via the OR gate 138 shown in FIG. 1, thus rendering the key range selection circuit 12 in a disable state. Upon generation of a point over signal PO in accordance with a point scoring and displaying operation described later, it is possible to start the next rally in a manner similar to that described in the above described mishitting.

The point scoring and display operations differ under generation of the excessive and deficient speed signals.

Under generation of the excessive speed signal $EX_H$, the output Q of the D-type flip-flop 148, to which the signal $S_2$, i.e., the output Q of the flip-flop 128 is inputted, is turned to be "1" in response to the excessive speed signal $EX_H$. Thus, the EXCLUSIVE OR gate 150 delivers an inverted signal of the selection control signal CC as a point control signal PC. Thereafter, a bell sound indication that either one of the players scored a point is generated upon reception of the output signal BC from the OR gate 140 shown in FIG. 1. Upon cessation of the bell sound, the point scoring and display circuit 144 scores and displays a point in such a manner as the player who hit the ball at an excessive high speed loses a point, as opposed to the case of the above described mishitting. That is, the player at the side of the second key range $KR_2$ obtains a point when the selection control signal is "1", and the player at the side of the first key range $KR_1$ obtains a point when the selection control signal is "0". Such operation of a point scoring and display means that the player loses a point when he returns a ball whose initial speed at the time of ball hitting is faster than that of the upper limit speed, i.e. the returned ball goes over the base line.

Contrary to the above, under generation of the deficient speed signal $EX_L$, the point control circuit 146 delivers the selection control signal CC directly as the point control signal PC without being inverted so that the operation executed by the point scoring and display circuit 144 is the same as in the case of the above mishitting. This means that the player loses a point when he returns a ball whose initial speed at the time of ball hitting is slower than that of the lower limit speed.

As shown in FIG. 2, it is appreciated that since the deficient speed signal $EX_L$ renders the AND gate 120 non-conductive through an inverter 118 to prevent the generation of the delayed hitting signal NEQ', musical tones are generated simulating the ball running behind the racket, while on the other hand since the delayed hitting signal NEQ' is generated under generation of the excessive speed signal $EX_H$, musical tones are generated simulating the ball returned at a high speed toward toe player who returned a high speed ball.

After repeating such a rally and if either one of the players at the first or second key ranges gains, for example, four points, the point scoring and display circuit 144 generates a game over signal GO. The game over signal GO makes it possible for a fanfare data generation circuit 164 to supply a fanfare data to the musical tone signal generation circuit 20 thereby causing a fanfare sound to be generated from the loudspeaker 22. Upon cessation of the fanfare sound, the fanfare data generation circuit 164 generates a fanfare finish signal $FN_2$. The signal $FN_2$ resets the flip-flop 16 and latch circuits 68 and 76, thereby indicating that a game is finished.

Although the invention has been described in its preferred form with a certain degree of particularity, it is understood that various changes and modification may be made in the invention without departing from the spirit and scope thereof. One obvious modification of the circuitry is that the keys for initiating to deliver a service can be replaced independently from the keys in the keyboard for other suitable element such as a service switch or switches. Further, though the embodiment shown herein is constituted by hard logic circuits, it is also possible to embody the present invention utilizing a micro computer having an associated set of appropriate programs.

What is claimed is:

1. An electronic musical instrument capable of carrying out a musical game which simulates a ball hitting game, comprising:

keyboard means having a plurality of keys for generating a first key data corresponding to a pitch of key depressed among said plurality of keys;

data generating means for generating, separately from a key depression on said keyboard, a second key data representing a pitch of a key and varying its pitch in either one of opposite directions to sequentially take a higher and a lower pitch respectively;

musical tone generating means for producing one after another musical tones which correspond to said sepuentially varying second key data so that a player may select and depress, through listening to the produced tones, a key on the keyboard which he considers to correspond to a tone being produced when the player depresses the key;

means for comparing said first and second key data for generating a coincidence signal when both said first and second key data substantially coincide with each other within a predetermined pitch difference therebetween; and means responsive to said coincidence signal for causing said data generating means to determine the direction of further pitch variation of said second key data.

2. An electronic musical instrument according to claim 1, further comprising speed control means for changing variation speed of said second key data and generating a variation rate data which varies gradually, upon generation of each second key data, to represent a lower variation rate, said data generating means being responsive to said variation rate data thereby to generate said second key data which varies at a rate according to the variation rate data.

3. An electronic musical instrument according to claim 1, in which said means responsive to said coincidence signal changes, when said coincidence signal is generated, the direction of said further pitch variation of said second key data to a direction opposite to the direction in which the second key data has varied precedingly to said coincidence signal and maintains the same direction in the absence of said coincidence signal even when a key is depressed to produce the first key data.

4. An electronic musical instrument according to claim 2, in which said speed control means further comprises means for changing an initial rate of said pitch varation of said second key data at the time when said coincidence signal is generated, said initial rate being changed in accordance with a pitch difference between said first and second key data at the time when said coincidence signal is generated so that the initial data may be small when said pitch difference is small.

5. An electronic musical instrument capable of carrying out a musical game, comprising:

keyboard means having a plurality of keys for generating a first key data corresponding to a pitch of a key depressed among said plurality of keys;

data generating means for generating a second key data representing a pitch of a key and varying its pitch in either one of opposite directions to sequentially take a higher and a lower pitch respectively;

means for comparing said first and second key data for generating a coincidence signal when both said first and second key data substantially coincide with each other within a predetermined pitch difference therebetween;

means responsive to said coincidence signal for causing said data generating means to determine the direction of further pitch variation of said second key data;

musical tone generating means for producing a musical tone selectively corresponding to said first and second key data;

speed control means for generating a variation rate data which varies gradually to represent a lower variation rate;

said data generating means being responsive to said variation rate data thereby to generate said second key data which varies at a rate according to the variation rate data;

said speed control means further comprising means for changing an initial rate of said pitch variation of said second key data at the time when said coincidence signal is generated;

said initial rate being changed in accordance with a pitch difference between said first and second key data when said coincidence signal is generated, wherein said speed control means further comprises means for comparing said initial rate with predetermined upper and lower limit rates, and generating a limit signal when said initial rate is higher or lower than said respective upper and lower limit rates, said limit signal causing said means responsive to said coincidence signal to change the direction of said further pitch variation of the second key data to the opposite direction when said initial rate is higher than said upper limit rate, and maintaining the same direction when said initial rate is lower than said lower limit rate.

6. An electronic musical instrument capable of carrying out a musical game, comprising:

keyboard means having a plurality of keys for generating a first key data corresponding to a pitch of a key depressed among said plurality of keys, said plurality of keys being grouped into a first key range covering keys at a lower pitch and a second key range covering keys at a higher pitch;

key range selection means for selecting either one of said first and second key ranges and enabling to deliver said first key data only from said selected key range, data generating means for generating a second key data representing a pitch of a key and varying its pitch in either one of directions to sequentially take a higher and a lower pitch respectively;

means for comparing said first key data delivered from said key range selection means with said second key data for generating a coincidence signal when both said first and second key data substantially coincide with each other within a predetermined pitch difference therebetween;

means responsive to said coincidence signal for causing said data generating means to determine the direction of further pitch variation of said second key data, and for causing said key range selection means to determine the key range to be selected; and musical tone generating means for producing a musical tone selectively corresponding to said first and second key data.

7. An electronic musical instrument according to claim 6, in which said means responsive to said coincidence signal changes, when said coincidence signal is generated, the direction of said further pitch variation of said second key data to a direction opposite to the direction in which the second key data has varied precedingly to said coincidence signal and maintains the same direction in the absence of said coincidence signal.

* * * * *